United States Patent [19]

Huang et al.

[11] Patent Number: 4,811,495

[45] Date of Patent: Mar. 14, 1989

[54] LAUNDRY DRIER

[76] Inventors: Mijuel E. J. Huang, 183, Neihu Rd., Sec. 2; Suyueh Chao, 2-1, Lane 162, Szu Wei Rd.; Chin-Ching Yu, 31, Lane 4, Tunhua N. Rd.; Chi-Chu Hsu, 4F, No. 144, Chu Lin Rd., Yung Ho, all of Taipei, Taiwan

[21] Appl. No.: 144,101

[22] Filed: Jan. 15, 1988

[51] Int. Cl.[4] ..... F26B 11/02

[52] U.S. Cl. ..... 34/131; 34/135; 34/136

[58] Field of Search ..... 34/133, 131, 138

[56] References Cited

U.S. PATENT DOCUMENTS

| | | | |
|---|---|---|---|
| 3,882,613 | 5/1975 | Wilson | 34/133 X |
| 4,204,338 | 5/1980 | Bullock | 34/133 X |
| 4,262,430 | 4/1981 | Jansen et al. | 34/133 X |
| 4,270,282 | 6/1981 | Lotz | 34/133 X |
| 4,516,331 | 5/1985 | Yamauchi et al. | 34/133 X |
| 4,615,125 | 10/1986 | Wyborn | 34/133 X |

*Primary Examiner*—Steven E. Warner

*Attorney, Agent, or Firm*—Morton J. Rosenberg

[57] ABSTRACT

An improved laundry drier which includes an outer case as well as an inner case and a tub which is rotationally driven. There is provided a heating housing having heating elements contained therein. A blower is located beneath the heating elements in the heating housing. A first electromagnetic valve is located in a passage of a suction duct. A branch duct is formed into the passage and is in fluid communication with a suction end of the blower. A second electromagnetic valve is formed in the branch duct to control fluid communication between the passage of the suction duct and a spraying duct. There is provided a vacuum apparatus disposed therein. Hot air may be circulated through the spraying duct and finally through the blower and the heating elements in the heating housing during a drying process. The mixture of the used hot air and steam obtained after drying may be exhausted from the tub and brought to water to be cooled and condensed before it is discharged by the vacuum device during an exhaust process.

1 Claim, 3 Drawing Sheets

LAUNDRY DRIER

BACKGROUND OF THE INVENTION

This invention relates to a drying machine, particularly to a drying machine for dry laundry such as clothes and sheets.

The structure of a conventional drying machine for dry laundry, as shown in FIG. 1, usually includes: an outer case 1 having a port hole 13, which can be closed by door 12, located in the front side wall; a control panel 11 fixed on the upper portion of said front side wall; a discharge hole 16, with a wire net 15 disposed thereof to prevent the introduction of unexpected deposites, located in the lower portion of one of the side walls and communicating with a fan aspiration room 17; a tub 2 having a plurality of orifices 21 evenly located in the periphery 29 and an opening 22 corresponding to said port hole 13 for permitting laundry to be sent in and taken out after drying; a lateral shaft 23 with one end fixed coaxially on a side plate 28 of said tub 2 and a grooved wheel 24 fixed on the opposite end of the shaft 23, which is rotatably and horizontally supported by a side wall of a inner case 18 mounted between the outer case 1 and the tub 2. The inner case 18 is formed with a hole corresponding to the opening 22 of the tub 2 and the port hole 13 of the outer case 1. Said wheel 24 can be driven to rotate by a proper power source such as motor 6 fixed beneath the inner case 18 through a belt 63; a supporting roller 25 rotatably fitted on a horizontal shaft 251 with one end fixed in said inner case 18 for supporting the tub 2; a spraying duct 31 and a suction duct 32 adjacent to the periphry 29 of the tub 2, which have several spraying openings 311 and suction openings 321 perpendicularly formed, fixed oppositely on the inner case 18. The spraying duct 31 is communicatively connected to a heating room 4 formed in a lower portion of the outer case 1 having a series of heating elements 41. And the opposite suction duct 32 is connected to said fan aspiration room 17, where in, a fan 51 can be driven by a motor 5 for sucking fluid through the suction duct 32.

When executing the drying of laundry, select the drying temperature and time, and press the start button on the control panel 11, thus several functions can be conducted simultaneously as follows: (a) The heating elements 41 are O to heat the air in the room 4; (b) The motor 6 is started to drive the wheel 24 and the tub 2 to rotate togather with the loaded laundry by the shaft 23; (c) The rotation of the fan 51 driven by the motor 5 facilitates the suctions of steam which is formed by heating the water contained in the laundry with the hot air sprayed into the tub 2 by the spraying duct 31.

The mixtures of said steam and hot air is aspirated and then discharged through hole 16, and thus completes the drying process.

The defects of the known drying machines are as follows:

1. The stay of the hot air sprayed into the tub 2 through the spraying duct 31 is not long enough to permit sufficient heat exchange between the hot air and the water contained in the laundry before exhausting, thus the air in the heating room 4 is heated continuously through the whole drying process, and it is obviously energy consuming and uneconomical.

2. The aspiration conducted by the fan 51 facilitates the flow of hot air in the tub 2 to flow through gaps formed between clothes instead of the laundry containing water, the drying process thus provided is inefficient and time consuming;

3. The hot air and the steam discharged will raise the room temperature and humidity where the drying machine is placed, and is sometimes full of the smell of added detergents.

SUMMARY OF THE INVENTION

It is accordingly a primary object of this invention to provide an improved drying machine to overcome the defects described above.

According to the present invention, this and other objects are achieved by providing a hot air circulating process and submergences of the used hot air and the steam formed therewith before discharge. The suction duct is connected to a water tank having a vacuum apparatus fixed in the opposite side. A series of orifice plates having a plurality of submerged orifices are vertically fixed in the tank between said connection and the vacuum apparatus; An electromagnetic valve is provided in a passage of the suction duct; A branch duct having another electromagnetic valve is formed priorly to the prior electromagnetic valve in the passage; A blower, with its suction end connected with said branch duct and the discharge end communicative with the spraying duct, is fitted in the heating room. Said two electromagnetic valves are exclusively arranged for permitting hot air to circulate along the route of the spraying duct, the tub, the suction duct, the branch duct, the blower and the heating room during drying process. The circulated mixture of used hot air and the steam is sucked from the tub by the suction duct into the water tank and further drawn to submerge in water before discharge during exhausting.

The advantages and characteristics of this invention will become clear from the following description of a preferred embodiment when read in conjunction with the accompanying drawings.

DETAILED DESCRIPTION OF THE PREFERRED EMBODIMENT

Figure 1:
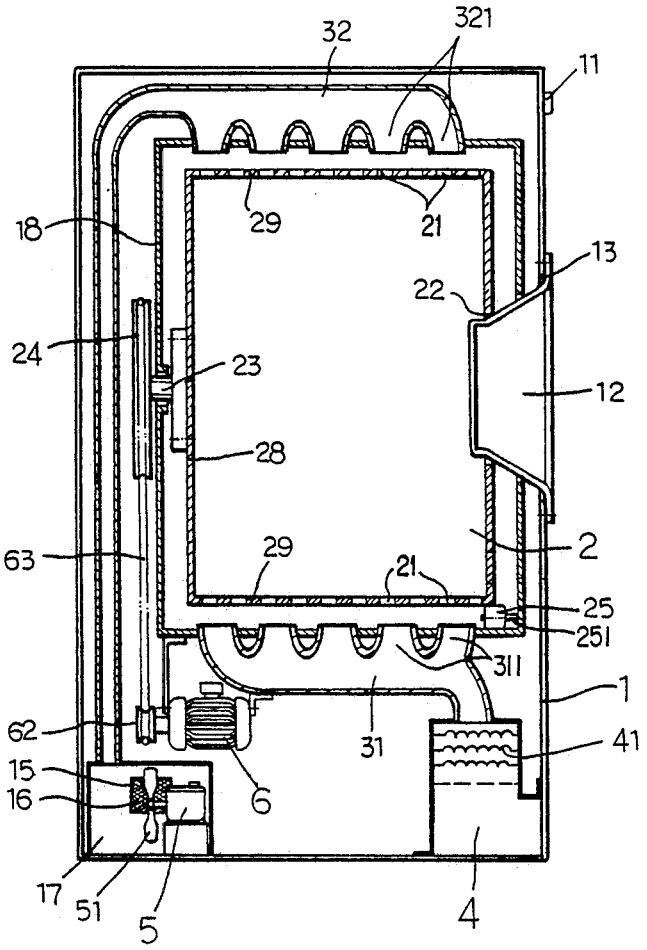
(PRIOR ART) FIG.1
FIG. 1 is a sectional view of a conventional drying machine.
Figure 2:
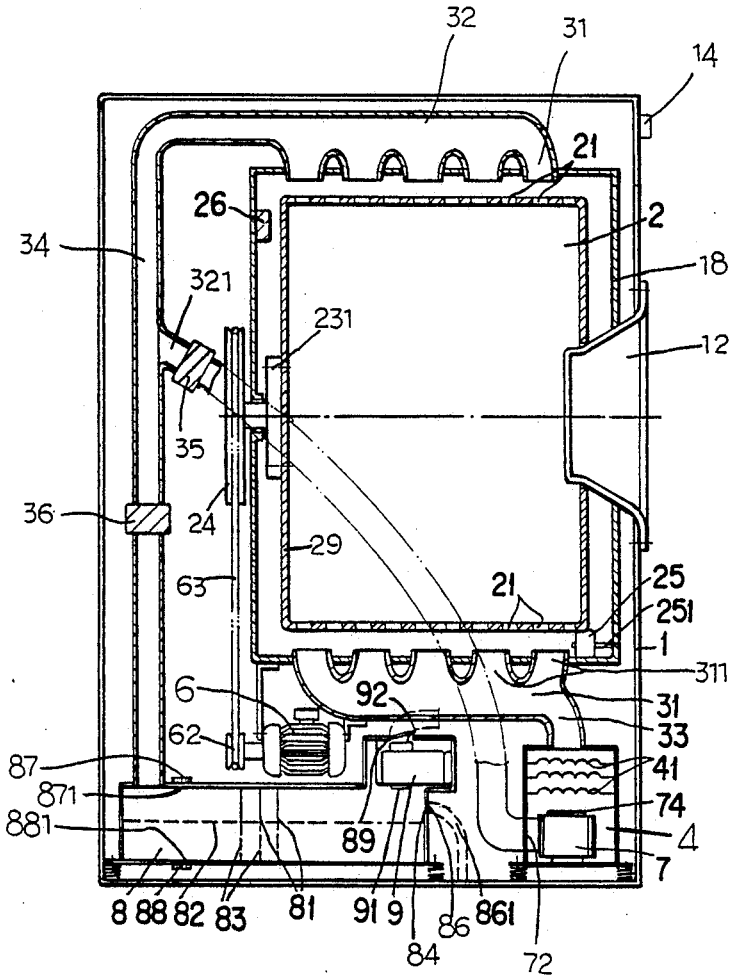
FIG. 2 is a sectional view of a drying machine embodying the present invention.
Figure 3:
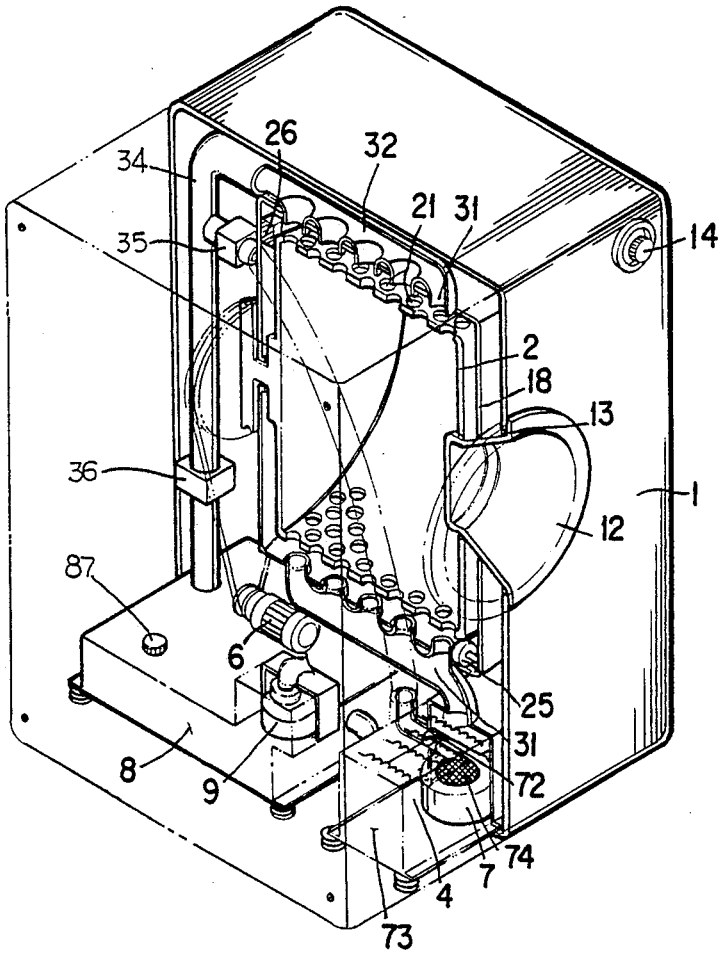
FIG. 3 is a perspective view of FIG. 2.

Referring to FIGS. 2 and 3, the drying machine according to the present invention comprises substantially the same basic parts such as outer case 1 , inner case 18 , tub 2 and its rotation driving assembly, spraying duct 31, suction duct 32, door 12, supporting rollers 25 and so on as shown in FIG. 1 ; a blower 7 having a suction end 72 and a discharge end 74 is disposed beneath the heating elements 41 in the heating room 4; An electromagnetic valve 36 is mounted in a passage 34 of the suction duct 32 which is connected to a water tank 8; An electromagnetic valve 35 is mounted in a branch duct 321 formed in the passage 34 priorly to said electromagnetic valve 36. The valves 35 and 36 are exclusively arranged inbetween, it means that one of the electromagnetic valves 35,36 is open, while the other valve is closed. Said branch duct 321 is communicatively connected to the suction end 72 of the blower 7, as the dotted lines in FIG. 2 shows. Said water tank 8 includes a hole 871, which can be closed by a lid 87, formed at the top of the tank for adding clean water to a proper level (such as the horizontal dotted line 82 in FIG. 2 shows); a drain hole 881, which can be sealed by a lid 88 or other proper means, formed at the bottom of the tank 8 for draining off the used water in the tank when necessary; a series of orifice plates 81 having a plurality of orifices 83 formed in the submerged portions of the plates 81, vertically fixed in the tank 8; a leak hole 84 located closely above the water surface 82 and connected with a pipe 861 to leak the excess water in the tank 8 automatically; a check valve 86 disposed on the leak hole 84; a vacuum pump 9, having an intake end 91 and a discharge end 92, terminally disposed in the tank in opposition to the connection of the passage 34 at a position which is properly higher than the water surface 82. Said intake end 91 of the vacuum pump 9 communicates with the space above the water surface 82 and the discharge end 92 is connected to the outside of the case 1 through a check valve 89. The check valves 86 and 89 are arranged in ways that when the vacuum pump 9 is started to run, the check valve 89 is open for air discharge from the discharge end 92 while the check valve 86 is closed to prevent the reverse flow of air through the hole 84 and the pipe 861. Alternatively, when the pump 9 is stopped, the check valve 89 close the discharge end 92 by weight immediately to prevent the reverse flow of air into tank 8 and the check valve 86 is open only when overflowing. The maintenance of low pressure or vacuum covering the water tank 8 and the tub 2 can thus be achieved; a thermostate 26 is fixed closely to the tub 2 to automatically control the heating elements 41 by detecting the temperature around the tub 2. The drying temperature can be selected at the control panel 14, and the thermostate 26 will follow the selection and automatically maintain the temperature of circulating hot air within a range, such as the presetting temperature range of 120° C.-85°C.

The drying programs provided by the present invention are executed after the selection of drying temperature and press of the start button on the control panel 14 as follows:

1. The electromagnetic valve 36 is open while the other valve 35 is closed and the vacuum pump 9 is started to suck air in the tub 2 through the suction duct 32 and discharge it outside to reduce the air pressure thereof, and the tub 2 is driven to rotate by the driving assembly simultaneously;

2. The vacuum pump 9 is OFF when the necessary vacuum is achieved and the electromagnetic valve 35 is open while the other electromagnetic valve 36 is closed, and the hot air heated by the heating elements 41 in the room 4 is blown into the spraying duct 31 to spray into the tub 2, and is sucked from the opposite side through the suction duct 32 which is now communicative with the suction end 72 of the blower 7. It is apparent to those skilled in the art that the low air pressure or vacuum facilitates the vaporization of water contained in the laundry to be dried under heating. The used hot air mixed with steam, which is formed by the heat exchange, stops its circulation until the temperature in the tub 2 reaching the presetting minimum temperature;

3. The electromagnetic valve 36 is open again ( the electromagnetic valve 35 is obviously closed), and the vacuum pump 9 is started to suck the circulated mixture of the used hot air and the steam through the suction duct 32 into the water tank 8 and to be drawn in advance to submerge in the water. The steam is condensed in the water and the used hot air is cooled and drawn continuously to pass through the orifices 83 of the orifice plates 81. Said air then gets rid of the water upward and is discharged outside by the vacuum pump 9.

4. The process as described above is repeatedly executed for several times according to the drying time in correspondence with the wetness or materials of the laundry to complete the drying movement.

The preferred embodiment of this invention resides in the following features:

(1) Since the hot air is circulated, the heat exchange between the hot air and the laundry loaded in the tub 2 is repeatedly and sufficiently proceeded, and it is obviously energy saving and economical;

(2) The discharged air is cooled and smell-less due to its submergence in the water before discharge;

(3) The low air pressure or vacuum in the tub 2 provided by the present invention facilitates the vaporization of the water contained in the laundry under heating and it is also energy saving and economical.

It will be appreciated, of course, that although a particular embodiment of the invention has been shown and described, mofifications may be made. It is intended in the following claim to cover all modifications which fall within the scope of the invention.

What is claimed is:

1. A drying machine comprises :

an outer case having a port hole located in the front side wall;

a door mounted on the front side wall of the outer case in correspondence with the port hole for opening or closing said port hole;

a control panel disposed on the upper portion of said front side wall for operation;

a tub having a plurality of orifices evenly located in the periphery and an opening corresponding to said port hole for loading and unloading the laundry to be dried;

an inner case fixed between said outer case and tub having a hole corresponding to said port hole and opening;

a shaft rotatably and substantially horizontally supported by a side wall of the inner case with one end fixed coaxially on a side plate of the tub and the opposite end fixed with a grooved wheel which can be driven to rotate by a properly disposed motor through a belt;

a spraying duct adjacent to the periphery of the tub having several perpendicularly formed spraying openings fixed on the inner case;

a heating room having a series of heating elements and a blower with a suction end and a discharge end disposed underneath the series communicatively connected with said spraying duct for blowing hot air into the spraying duct when necessary;

a suction duct adjacent to the periphery of the tub, having a passage with an electromagnetic valve disposed therein and several suction openings formed substantially correspondingly to the spraying openings of the spraying duct, fixed in opposition to the spraying duct on the inner case;

a branch duct having an electromagnetic valve formed in the passage priorly to the prior electromagnetic valve and communicatively connected with the suction end of the blower;

a water tank having a hole, which can closed by a lid and formed at the top of the tank for adding clean water to a proper level, a drain hole, which can be sealed by a lid or other proper means and formed at the bottom of the tank for draining off the used water in the tank when necessary, and a leak hole located closely above the water surface for leaking the excess water automatically, fixed in the lower portion of the outer case and communicatively connected with the passage of the suction duct;

a series of orifice plates having a plurality of orifices formed in the submerged portions of the plates vertically and compartmentally fixed in the middle portion of the tank;

a vacuum apparatus disposed in the tank in opposition to the connection of the passage at a position higher than the water surface for discharging the air after a submergence; whereby, the electromagnetic valves are arranged in the way that one of the electromagnetic valves is open while the other valve is closed thus a drying process of the circulation of hot air under low pressure or vacuum along the route of said spraying duct, tub, suction duct, branch duct, blower and heating room and the discharge of circulated and submerged mixture of the used hot air are completed accordingly.

* * * * *